US005285822A

United States Patent [19]

Josefsson et al.

[11] Patent Number: 5,285,822

[45] Date of Patent: Feb. 15, 1994

[54] CONTROL PANEL ARRANGEMENT FOR AN ELECTRONICALLY CONTROLLED WEFT PROCESSING UNIT

[75] Inventors: Paer Josefsson, Boras; Thomas Hallberg, Goeteborg, both of Sweden

[73] Assignee: IRO AB, Ulricehamn, Sweden

[21] Appl. No.: 768,671

[22] PCT Filed: Apr. 6, 1990

[86] PCT No.: PCT/EP90/00544

§ 371 Date: Nov. 29, 1991

§ 102(e) Date: Nov. 29, 1991

[87] PCT Pub. No.: WO90/12135

PCT Pub. Date: Oct. 18, 1990

[30] Foreign Application Priority Data

Apr. 7, 1989 [DE] Fed. Rep. of Germany ..... 3911411

[51] Int. Cl.[5] ..... D03D 47/36; D03D 49/02

[52] U.S. Cl. ..... 139/452; 139/1 R

[58] Field of Search ..... 364/921.1, 470; 139/1 R, 452

[56] References Cited

U.S. PATENT DOCUMENTS 4,716,943 1/1988 Yoshida et al. .

4,815,501 3/1989 Takehana ..... 139/452 X 4,852,617 8/1989 Hamer et al. ..... 139/452

4,924,917 5/1990 Shaw ..... 139/452

*Primary Examiner*—Andrew M. Falik

*Attorney, Agent, or Firm*—Flynn, Thiel, Boutell & Tanis

[57] ABSTRACT

An electronically controlled weft yarn processing unit having a weft yarn feed system arranged separately in the vicinity of a weaving machine. The yarn feed system including at least one yarn feeder having a separate drive motor including an electronic control unit and monitoring and control elements. The yarn feed system further including a first input and indicating section connected to the electronic control unit of the yarn feeder for adjusting at least one functional parameter including a speed limit of the drive motor, a weft yarn length, a sensitivity of the monitoring and control elements, a reference value for a weft yarn store size, and a weft yarn store offset. The weft yarn processing unit also having an operation and control panel provided on a weaving machine. The first input and indicating section is located within the control and operation panel on the weaving machine. The first input and indicating section is connected to the electronic control unit of the yarn feeder via a data transmission link for transmitting at least one of the functional parameters to the yarn feeder.

6 Claims, 1 Drawing Sheet

CONTROL PANEL ARRANGEMENT FOR AN ELECTRONICALLY CONTROLLED WEFT PROCESSING UNIT

FIELD OF THE INVENTION

The present invention refers to an electronically controlled weft yarn processing unit.

BACKGROUND OF THE INVENTION

Yarn feeders are accessory parts for weaving machines. They are normally not produced by the same manufacturers as the weaving machine. Said yarn feeders are universally usable for various types of weaving machines, and they are adapted to the respective weaving machine from case to case. Each yarn feeder is an independent unit having a separate drive means, a separate control of the drive means and separate monitoring and control elements. If several yarn feeders are associated with one weaving machine, they will be combined in a yarn feed system, which is installed separately from the weaving machine as a structural unit. The final consumer or rather the person making use of the weaving machine frequently buys the respective type of yarn feeder from the manufacturer of the yarn feeder, and he often asks the manufacturer to mount and to adjust the yarn feeder. Electronically controlled weft yarn feeders are equipped with an input and indicating section for functional parameters, such as the limit speed of the drive means, the weft yarn length, the sensitivity of the various sensors provided, the reference value of the weft yarn store size, the variation of the weft yarn store size, the weft yarn store offset and the like. These functional parameters are inputted by means of a keyboard and switches, and, if necessary, they are displayed by means of a display. In certain cases, a functional parameter is also changed while the machine is in operation. The display also serves to display mistakes or malfunctions in the case of operating trouble. The input and indicating section is provided on the housing of the weft yarn feeder at an easily accessible location. In a yarn feed system comprising several weft yarn feeders, a central control unit can be provided which has connected thereto all the weft yarn feeders. If the weft yarn feeders should then no longer have any separate input and indicating sections, the central control unit will be equipped in an appropriate manner. In practice, it becomes increasingly common to equip a weaving machine already at the manufacturer's firm with a weft yarn feed system, which is specially designed to meet the requirements of said weaving machine and which the manufacturer of the weaving machine offers and delivers as one unit together with the weaving machine. In spite of this fact, the independence of the weft yarn feed system has hitherto been maintained with regard to the adjustment of the functions in the weft yarn feed system presumably because the functional parameters of the yarn feeders are so different from the functional parameters of the weaving machine and because a direct connection between said functional parameters of the yarn feeders and the functions of the weaving machine does not necessarily exist, and because the yarn feed system is, in principle, structurally separated from the weaving machine in spite of the fact that it cooperates with said weaving machine when in operation. The independent adjustability of the yarn feeders in the weft yarn feed system by separate adjustment and indicating sections entails an inexpedient necessity of using additional devices. Moreover, the devices are difficult to operate, since the operating and control panel of the weaving machine is locally separated from the adjustment and indicating sections of the weft yarn feed system and has to be operated in a different manner in most cases. This may result in a loss of time and in misoperations on the part of the operators who have primarily been trained to operate the weaving machine.

Furthermore, it was suggested that a real-time data communication should be provided between the weft yarn feed system and the weaving machine so that, taking into account the complex sequences of functions and the high frequency of functions occurring in the operation of the weaving machine, there is communication between the weaving machine and the yarn feeder which facilitates the feed work of the yarn feeder and which increases the functional reliability of the whole system. The real-time data transmitted between the weaving machine and the yarn feeder in the case of such communication are significant trig-signals which occur in the program sequence of the weaving machine and which are processed directly in the program sequence of the yarn feeder. These real-time data do not have any influence on functional parameters for the yarn feeder. The functional parameters are set prior to putting the unit into operation.

The present invention is based on the task of simplifying the operability of an electronically controlled weft yarn processing unit, increasing the functional reliability of said unit and optimizing its range of use.

SUMMARY OF THE INVENTION

The present invention relates to an electronically controlled weft yarn processing unit having a weft yearn feed system arranged separately in the vicinity of a weaving machine. The yarn feed system includes at least one yarn feeder having a separate drive means with an electronic control unit and monitoring and control elements. The yarn feed system also includes a first input and indicating section connected to the electronic control unit of the yarn feeder for adjusting one or more functional parameters including a speed limit of the drive means, a weft yarn length, a sensitivity of the monitoring and control elements, a reference value for a weft yarn store size, and weft yarn store offset. The weft yarn processing unit also has an operation and control panel provided on the weaving machine. The first input and indicating section is located within the operation and control panel on the weaving machine and is connected to the electronic control unit of the yarn feeder via a data transmission link for transmitting the functional parameter(s) to the yarn feeder.

In an expedient embodiment a central control unit is provided in the weft yarn feed system comprising several yarn feeders, said central control unit being connected to the control units of the yarn feeders. The individual yarn feeders will, in this case, be addressed via the central control unit of the weft yarn feed system, if any functional parameters have to be set or changed. This is, however, done centrally from the operational and functional control panel of the weaving machine.

Another advantageous feature is the means for identifying at least one yarn feeder to facilitate the setting or changing of the parameters.

BRIEF DESCRIPTION OF THE DRAWING

The drawing shows a schematic front view of a weft yarn processing unit.

DETAILED DESCRIPTION

Figure 1:
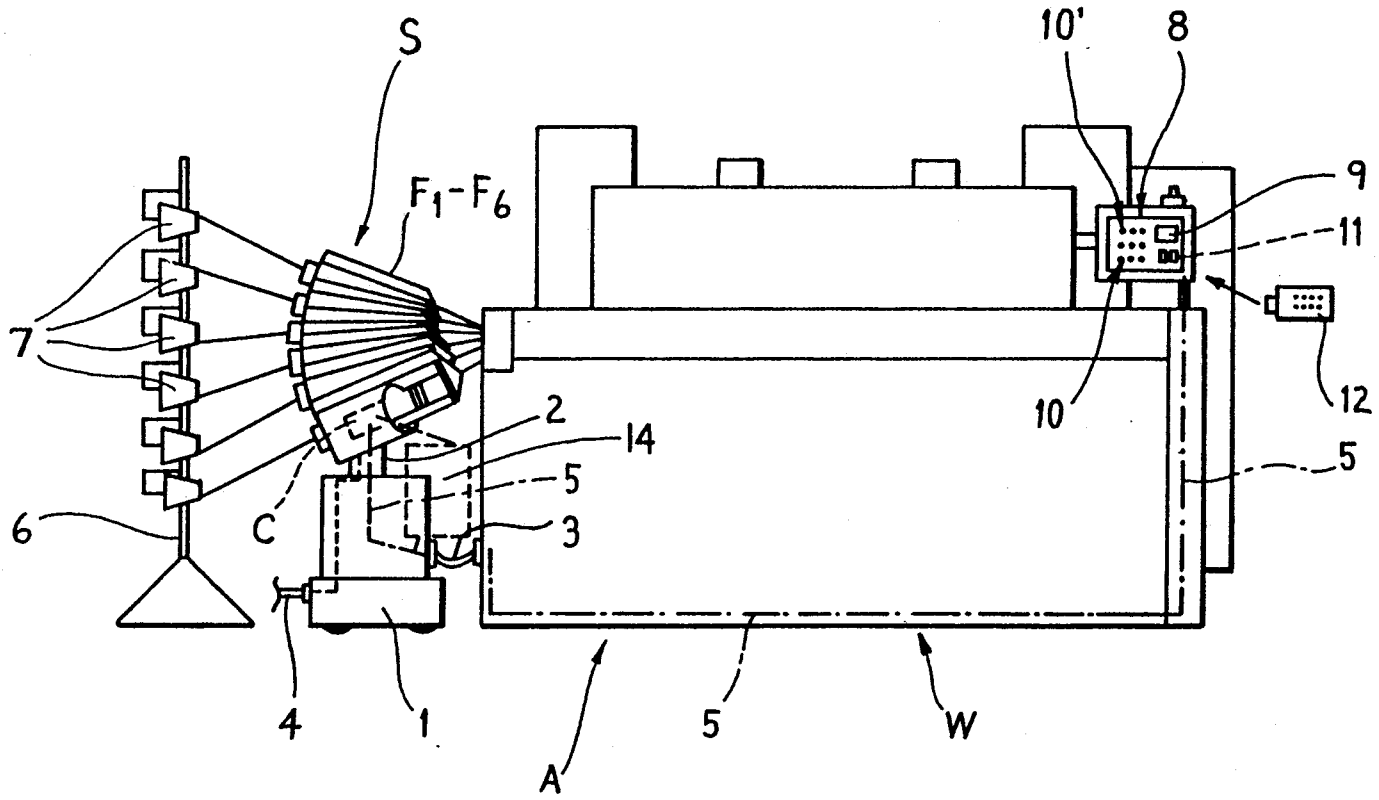

The weft yarn processing unit A consists of a weaving machine and of a weft yarn feed system S, which is arranged separately from said weaving machine and which is provided with six yarn feeders F1–F6 in the case of the embodiment shown. Each yarn feeder F1–F6 includes a separate drive means (not shown) with separate control and monitoring members (not shown either) as well as a control unit C for the drive means. The yarn feeders F1–F6 are detachably mounted on a holding means 2 of a frame 1, which can be adapted to be displaced on the ground. Via a connection line 4, the yarn feeders F1–F6 of the weft yarn feed system S are supplied with energy. The weaving machine W takes weft yarns of a predetermined weft yarn length from the yarn feeders F1–F6 in accordance with a pattern-dependent cycle. At the side of the weft yarn feed system S, a plurality of bobbins 7 is arranged on a frame 6, the yarn feeders F1–F6 unwinding their weft yarns from said bobbins.

The weaving machine W has attached thereto an operational and functional control panel 8, which is adapted to be used for adjusting and changing functional parameters for the weaving machine and which includes, for this purpose, an input section 10 having inputting elements and an indicating device 9, e.g. in the form of a display having indicating elements. A data transmission link 5 (indicated by a dot-and-dash line) is established between the operational and functional control panel 8 and the control units C of the yarn feeders F1–F6; in the present case, said data transmission link extends within the frame 1 and via a connection cable 3 to the weaving machine W and then through said weaving machine W up to the operational and functional control panel 8 of said weaving machine W. The cable connection 3 can be established by means of conventional connector elements. The inputting and indicating elements for the weaving machine can also be used for setting and changing the functional parameters for the yarn feeders.

It is to be understood that the data transmission link 5 can be adapted for either directional or bidirectional data flow in either a serial or parallel data transmission format. Furthermore, it is envisioned that data may be entered in block format for batch processing operations across the data transmission link 5.

For adjusting functional parameters of the yarn feeders, an input and indicating section 10' is provided in the operational and functional control panel 8 of the weaving machine W. It will be expedient when the same input and indicating section can be used for the weaving machine and for the yarn feeders. It is, however, also possible to provide a separate input and indicating field for the functional parameters of the yarn feeders F1–F6. The functional parameters of the yarn feeders to be adjusted are, for example: the limit speed of the drive means, the weft yarn length, the sensitivity of the various sensors (photocells or the like, e.g. determination of the store size and of the yarn take-off), a reference value for the weft yarn store size in the yarn feeder, the variation range of the weft yarn store size when the unit is in operation, the weft yarn store offset and the like. These functional parameters are adjusted or changed prior to putting the unit into operation. It is perfectly possible to input one parameter adjustment at the operational and functional control panel of the weaving machine and to transmit this functional parameter adjustment then to all yarn feeders simultaneously or to one yarn feeder after the other via the means for identifying the individual yarn feeders. With the aid of these means it is, however, just as well possible to select only one yarn feeder from the weft yarn feed system and to adjust or to change the functional parameters of said yarn feeder.

In the drawing, it is additionally indicated that a plug-in connection 11, which is used for attaching a control device 12 which is programmed in advance for adjusting and changing the functional parameters for the yarn feeders F1–F6, can be provided in the operational and functional control panel 8 of the weaving machine W. It will be expedient when this control device is a programmable personal computer, which can be detached, when the functional parameters have been set or changed, and used in combination with a different weaving machine in the same manner. The control device 12 may, however, also remain on the panel 8. It will be expedient when the control device 12 is programmed with the functional parameters and then attached so that the data transmission of the functional parameters can take place in an appropriate manner via the data transmission link 5. The control device can also be transported from one weaving machine to the next, where it can be used again for adjusting or changing the functional parameters.

Several yarn feeders F1–F6 are shown in the weft yarn feed system S. However, the weft yarn feed system 5 may also consist of only one single yarn feeder.

If, in the case of the weft yarn feed system S comprising several yarn feeders F1–F6, a central control unit 14 is provided for all yarn feeders, it will be expedient when the data transmission link 5 is connected to this central control unit so that the functional parameters will be transmitted to the respective selected yarn feeders by said central control unit. The yarn processing unit A is in conformity with the tendency to offer, deliver and install weaving machines as a complete unit which already includes the yarn feed system so that the hitherto existing equivalence between the objects: weaving machine and yarn feed system is given up in favor of a predominance of the weaving machine. However, it is thus possible to achieve a central operation and supervision of the components, which are provided in the unit but which are, in actual fact, not structurally connected, and the operators will find it less difficult to manage and to understand this central operation and supervision. Furthermore, indirect pressure is intentionally exerted on the person making use of the weaving machine with regard to the fact that he should buy the complete weft yarn processing unit from one competent source and refrain from freely combining individual components in which case he would unintentionally accept compromises with respect to the range of use and the operational reliability of the whole system. In the case of this structural design, the two structurally separate components are, in the whole unit, coordinated in the best possible manner from the very beginning, and this excludes any detrimental influence which may be exerted by only partially compatible components, this being an influence which can be judged very well by the manufacturer of the weaving machine, whereas the person making use of the weaving machine will hardly be able to judge this. It follows that the unit can thus be used with the best possible efficiency throughout its whole range of use. Although the weft yarn feed system and the weaving machine remain, in principle, independent components in the unit, the weaving machine is caused to play a dominant role with regard to the fundamental adjustment, whereas the yarn feed system is pushed into the background in this respect. If, consequently, all adjustments are carried out and monitored centrally from the operation and control panel of the weaving machine, the operability will be simplified and it will be less difficult to avoid malfunctions or incorrect adjustments, since the operator has to carry out the adjustment of the functional parameters for the weft yarn feed system in the same manner as the adjustment of functional parameters of the weaving machine. The number of devices required is decreased, and, especially in cases in which a large number of yarn feeders are provided in the weft yarn feed system, this constitutes a substantial advantage, since the elements in the operational and functional control panel, which are required for the weaving machine anyhow, will also be used for setting the functional parameters of the weft yarn feed system.

We claim:

1. In an electronically controlled weft yarn processing unit having a weft yarn feed system arranged separately in the vicinity of a weaving machine, the yarn feed system including a frame having attached thereto at least one yarn feeder having a separate drive means with an electronic control unit, the yarn feed system further including an input and indicating section connected to the electronic control unit of said one yarn feeder for adjusting at least one functional parameter thereof, the functional parameter being one of the group consisting of a speed limit of the drive means, a weft yarn length, a sensitivity of the monitoring and control elements, a reference value for a weft yarn store size, and a weft yarn store offset, and the weft yarn processing unit also having an operation and control panel provided on the weaving machine, the improvement wherein said input and indicating section is located within said operation and control panel on said weaving machine, said input and indicating section being connected to said electronic control unit of said one yarn feeder via a data transmission link for transmitting said at least one functional parameter to said one yarn feeder.

2. A yarn processing unit according to claim 1, wherein said input and indicating section further includes means for identifying said one yarn feeder.

3. A yarn processing unit according to claim 1, wherein said operation and control panel includes a second input and indicating section for controlling the operation of the weaving machine, said second input and indicating section including input and indicating elements which serve as input and indicating elements for the first-mentioned input and indicating section of the yarn feed system.

4. A yarn processing unit according to claim 1, wherein said operation and control panel further includes a plug-in connection for attaching an electronic, detachable control means to said operation and control panel for adjusting and changing said functional parameter.

5. A yarn processing unit as claimed in claim 4, wherein said control means is a personal computer.

6. A yarn processing unit as claimed in claim 1, wherein said yarn feed system includes a plurality of said yarn feeders each having a separate said electronic control unit, and further includes a central control unit connected to said electronic control unit of each of said plurality of yarn feeders, said data transmission link extending between said operation and control panel and said central control unit.

* * * * *